US011577924B2

(12) United States Patent
Suzuki et al.

(10) Patent No.: US 11,577,924 B2
(45) Date of Patent: Feb. 14, 2023

(54) EDGE POSITION DETECTING APPARATUS AND IMAGE FORMING APPARATUS

(71) Applicants: Rie Suzuki, Kanagawa (JP); Tatsuya Ishii, Kanagawa (JP)

(72) Inventors: Rie Suzuki, Kanagawa (JP); Tatsuya Ishii, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 146 days.

(21) Appl. No.: 17/104,469

(22) Filed: Nov. 25, 2020

(65) Prior Publication Data

US 2021/0163247 A1 Jun. 3, 2021

(30) Foreign Application Priority Data

Nov. 28, 2019 (JP) ..... JP2019-214997
Jul. 2, 2020 (JP) ..... JP2020-114824

(51) Int. Cl.

| | |
|---|---|
| ***B65H 7/10*** | (2006.01) |
| ***B65H 7/14*** | (2006.01) |
| ***B65H 7/20*** | (2006.01) |
| *G03G 15/00* | (2006.01) |

(52) U.S. Cl.

CPC ..... *B65H 7/10* (2013.01); *B65H 7/14* (2013.01); *B65H 7/20* (2013.01); *B65H 2553/414* (2013.01); *B65H 2553/416* (2013.01); *B65H 2557/50* (2013.01); *G03G 15/6561* (2013.01)

(58) Field of Classification Search

CPC ... B65H 7/00; B65H 7/02; B65H 7/10; B65H 7/14; B65H 7/20; B65H 43/04; B65H 43/08; B65H 2553/40; B65H 2553/41; B65H 2553/414; B65H 2553/416; B65H 2557/50

See application file for complete search history.

(56) References Cited

U.S. PATENT DOCUMENTS

| | | | | |
|---|---|---|---|---|
| 2007/0297821 | A1* | 12/2007 | Yamauchi | B65H 7/14 271/265.01 |
| 2015/0028533 | A1* | 1/2015 | Kato | B65H 3/0607 271/3.16 |
| 2015/0338812 | A1 | 11/2015 | Miura | |
| 2016/0173715 | A1 | 6/2016 | Suzuki et al. | |
| 2020/0099812 | A1* | 3/2020 | Ishii | B65H 7/14 |

FOREIGN PATENT DOCUMENTS

| | | |
|---|---|---|
| JP | 2008-003286 | 1/2008 |
| JP | 2016-000656 | 1/2016 |

* cited by examiner

*Primary Examiner* — Prasad V Gokhale

(74) *Attorney, Agent, or Firm* — Harness, Dickey & Pierce, P.L.C.

(57) ABSTRACT

An edge position detecting apparatus includes a light emitting device, a detecting device, and a calculating circuit. The light emitting device includes a plurality of light sources with different emission wavelengths. The light emitting device irradiates a conveyed object with linear light along a width direction of the conveyed object, the width direction being perpendicular to a conveying direction of the conveyed object. The detecting device detects, at a plurality of positions in the width direction of the conveyed object, intensity of reflected light of light emitted by the light emitting device. The calculating circuit calculates, based on a detection result of the detecting device, a position of an edge of the conveyed object in the width direction.

12 Claims, 9 Drawing Sheets

| COLOR OF PAPER | LIGHT SOURCE TO BE TURNED ON | EMISSION AMOUNT (CURRENT VALUE i [mA]) | | |
|---|---|---|---|---|
| | | RED LED 3r | GREEN LED 3g | BLUE LED 3b |
| BLUE | B | 0 | 0 | 50 |
| RED | R | 0 | 50 | 0 |
| YELLOW | RG | 31 | 31 | 0 |
| PINK | RB | 25 | 0 | 20 |
| BLACK | RGB | 20 | 15 | 25 |
| TRANSPARENT | RGB | 25 | 25 | 25 |

EDGE POSITION DETECTING APPARATUS AND IMAGE FORMING APPARATUS

CROSS-REFERENCE TO RELATED APPLICATIONS

The present application claims priority under 35 U.S.C. § 119 to Japanese Patent Application No. 2019-214997, filed on Nov. 28, 2019, and Japanese Patent Application No. 2020-114824, filed on Jul. 2, 2020. The contents of which are incorporated herein by reference in their entirety.

BACKGROUND OF THE INVENTION

1. Field of the Invention

The present invention relates to an edge position detecting apparatus and an image forming apparatus.

2. Description of the Related Art

In an image forming apparatus, high image position accuracy with respect to a printed material is demanded. However, when paper is conveyed, the paper may be displaced in a width direction perpendicular to a conveying direction in the image forming apparatus and it may become difficult to form an image at a desired position, which is a problem. To handling the problem as described above, a technology for recognizing a position at which the paper is conveyed, and forming an image in accordance with the recognized position has been known (for example, Japanese Examined Patent Application Publication No. 2016-000656). Specifically, an amount of displacement of a position of the paper in the width direction is detected by using an edge position detection sensor that detects a position of an edge of the paper on a conveying path.

The conventional edge position detection sensor as described above includes a sensor including light sources with different wavelengths (colors) and sequentially turns on the light sources to identify a position of an edge of paper by using a signal with which largest output power can be obtained. However, depending on a color or reflectance of the paper, it may be difficult to obtain expected output power even by using any of the light sources that are sequentially turned on. Therefore, there is a problem that it may be difficult to detect an accurate position of the edge of the paper.

Moreover, another method has been known, in which a plurality of light sources are simultaneously turned on to increase light intensity to thereby detect the position of the edge of the paper. However, in this method, high output power is obtained independent of the color or the reflectance of the paper, whereas light intensity may be excessive for paper with high reflectance. Therefore, there is a problem that power consumption of the sensor may increase.

SUMMARY OF THE INVENTION

According to one aspect of the present invention, an edge position detecting apparatus includes a light emitting device, a detecting device, and a calculating circuit. The light emitting device including a plurality of light sources with different emission wavelengths. The light emitting device is configured to irradiate a conveyed object with linear light along a width direction of the conveyed object, the width direction being perpendicular to a conveying direction of the conveyed object. The detecting device is configured to detect, at a plurality of positions in the width direction of the conveyed object, intensity of reflected light of light emitted by the light emitting device. The calculating circuit is configured to calculate, based on a detection result of the detecting device, a position of an edge of the conveyed object in the width direction.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
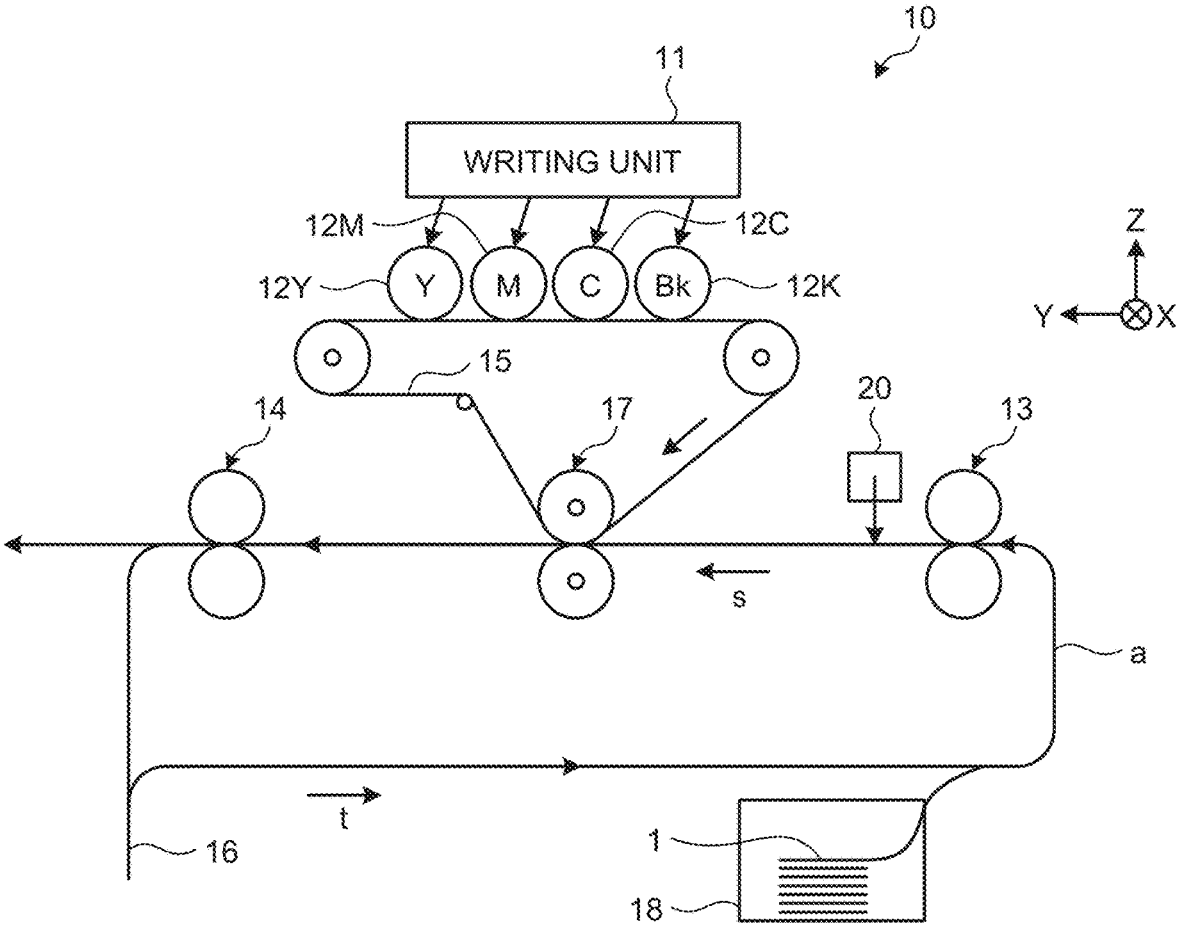
FIG. 1 is a configuration diagram illustrating an example of an entire configuration of an image forming apparatus according to a first embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An object of the present invention is to provide an edge position detecting apparatus and an image forming apparatus capable of reducing power consumption and handling various kinds of paper without deterioration of detection accuracy.

First Embodiment

An image forming apparatus 10 according to a first embodiment will be described below with reference to the accompanying drawings. FIG. 1 is a configuration diagram illustrating an example of an entire configuration of the image forming apparatus according to the first embodiment.

Configuration of Image Forming Apparatus

As illustrated in FIG. 1, the image forming apparatus 10 includes a writing unit 11, image forming units 12Y, 12M, 12C, and 12K of a tandem electro-photographic system, a transfer belt 15, a secondary transfer roller 17, a paper feed unit 18, a conveying roller pair 13, a fixing roller 14, and a reversing path 16.

Each of the image forming units 12Y, 12M, 12C, and 12K has an image formation process (a charging process, an exposure process, a developing process, a transfer process, and a cleaning process), forms a toner image in the image formation process on the basis of an instruction from the writing unit 11, and transfers the toner image onto the transfer belt 15. In the example illustrated in FIG. 1, a yellow toner image is formed on the image forming unit 12Y, a magenta toner image is formed on the image forming unit 12M, a cyan toner image is formed on the image forming unit 12C, a black toner image is formed on the image forming unit 12K, and the toner images of the respective colors are transferred from the image forming units 12Y, 12M, 12C, and 12K onto the transfer belt 15 in a superimposed manner. The types or the number of colors of toner are not limited to this example and the types or the number of colors of toner may be modified appropriately.

The transfer belt 15 moves in a predetermined direction and conveys toner images (full-color toner image), which are transferred in a superimposed manner from the image forming units 12Y, 12M, 12C, and 12K, to a secondary transfer position of the secondary transfer roller 17. For example, the transfer belt 15 moves in a clockwise direction. The yellow toner image, the magenta toner image, the cyan toner image, and the black toner image are sequentially transferred in a superimposed manner, and a full-color toner image is transferred to the secondary transfer position.

The paper feed unit 18 includes a paper feed tray in which conveyed objects as processing targets, that is, a plurality of recording media 1, are housed in a stacked manner. The paper feed unit 18 feeds the recording media 1 one by one from the paper feed tray onto a conveying path a. The recording medium 1 is, for example, recording paper (transfer sheet or paper), but is not limited thereto, and may be a different medium, such as coated paper, thick paper, an overhead projector (OHP) sheet, a plastic film, pre-preg, or copper foil, as long as an image is recordable on the medium. For easy understanding of explanation, XYZ coordinates are specified as illustrated in FIG. 1. The Y-axis indicates a conveying direction of the recording medium 1 at a position of the secondary transfer roller 17, that is, a direction of arrow s in FIG. 1. The X-axis indicates a width direction of the recording medium 1, which is perpendicular to the conveying path a. The Z-axis indicates a height direction of the image forming apparatus 10.

As an external option, in addition to the above-described paper feed unit 18, it may be possible to further connect the paper feed unit 18 that is capable of housing a different kind of the recording medium 1, and convey the recording medium 1 as a processing target alternately from the plurality of paper feed units 18 or in a switching manner by selection from the plurality of paper feed units 18.

The conveying roller pair 13 conveys the recording medium 1 fed from the paper feed unit 18 in the direction of arrow s of the conveying path a.

The secondary transfer roller 17 collectively transfers, at the secondary transfer position, the full-color toner image conveyed by the transfer belt 15 onto the recording medium 1 that is conveyed by the conveying roller pair 13.

The fixing roller 14 applies heat and pressure to the recording medium 1 on which the toner image has been transferred, and fixes the toner image to the recording medium 1.

In a case of one-side printing, the image forming apparatus 10 discharges the recording medium 1 to which the toner image is fixed. Further, in a case of duplex printing, the recording medium 1 to which the toner image is fixed is conveyed to the reversing path 16.

The reversing path 16 conveys the conveyed recording medium 1 in a switchback manner such that an opposite side of the recording medium 1 faces up, and conveys the recording medium 1 in a direction of arrow t. The recording medium 1 conveyed by the reversing path 16 is conveyed again by the conveying roller pair 13 in the direction of arrow s, a toner image is formed on the opposite side by the secondary transfer roller 17, the toner image is fixed by the fixing roller 14, and the recording medium is discharged.

A position detection sensor 20 includes a reading device 2 (see FIG. 2) in which a plurality of image sensors are aligned in a main-scanning direction (X) of the recording medium 1. The reading device 2 is disposed such that a reading surface faces the conveying path a of the recording medium 1. The position detection sensor 20 detects a position of an edge of the processing target recording medium 1 in a sub-scanning direction (Y) on the basis of an output value form the reading device 2, and corrects positional deviation of the recording medium 1 in the main-scanning direction (X). The position detection sensor 20 is one example of an edge position detecting apparatus according to the present disclosure.

The image forming apparatus 10 includes an operation panel (not illustrated in FIG. 1). The operation panel inputs various kinds of operation to the image forming apparatus 10. The operation panel displays, on the image forming apparatus 10, various kinds of information. The image forming apparatus 10 is not limited to the electro-photographic system described above. In other words, the image forming apparatus 10 may be of a different printing system, such as an ink-jet system. Further, the image forming apparatus 10 may be a continuous paper printer other than a cut sheet printer.

Configuration of Position Detection Sensor

Figure 2:
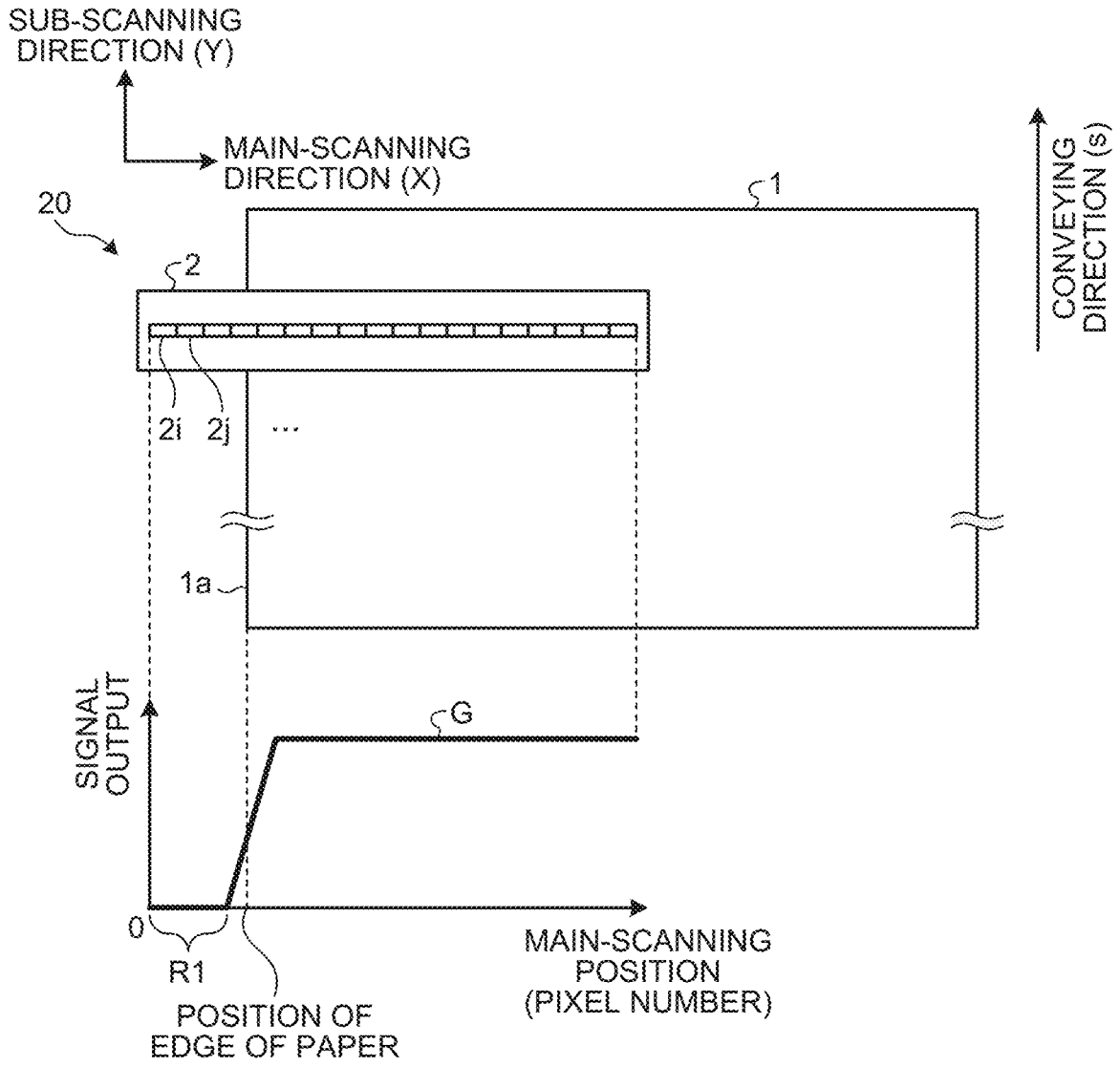
FIG. 2 is a configuration diagram illustrating an example of a schematic configuration of a position detection sensor.

An overview of the position detection sensor 20 will be described below with reference to FIG. 2. FIG. 2 is a configuration diagram illustrating an example of a schematic configuration of the position detection sensor. Specifically, FIG. 2 illustrates the reading device 2 included in the position detection sensor 20, and the recording medium 1 that passes through a position of the reading device 2. The recording medium 1 is conveyed in the conveying direction (an arrow s). In FIG. 2, the conveying direction (arrow s) of the recording medium 1 and the sub-scanning direction (Y-axis direction) are the same direction. On a plane of the recording medium 1, a direction perpendicular to the sub-scanning direction (Y-axis direction) is the main-scanning direction (X-axis direction).

The reading device 2 is, for example, a contact image sensor (CIS) in which a plurality of image sensors (for example, complementary metal oxide semiconductor (CMOS) image sensors) are linearly arranged. In FIG. 2, the reading device 2 is disposed such that the reading surface is oriented in a direction facing one side of the recording medium 1 and is located close to the one side. All image sensors (2*i*, 2*j*, and others) of the reading device 2 are linearly arranged along the main-scanning direction (X). The reading device 2 irradiates the recording medium 1 as a reading target with illumination light, causes a photodiodes to receive, at each of positions (main-scanning positions) of the image sensors (2*i*, 2*j*, and others) in the main-scanning direction (X), light that is reflected from each of positions, and outputs a pixel signal at each of the main-scanning positions subjected to photoelectric conversion as a signal output (image signal) in the main-scanning direction (X).

a dedicated light blocking member that blocks and absorbs the illumination light from the reading device 2 is disposed at a position facing the reading device 2. As illustrated in FIG. 2, the reading device 2 is disposed across an edge 1*a* that is an edge of the recording medium 1 in the main-scanning direction (X). With this configuration, in a time period in which the recording medium 1 passes through a space between the reading device 2 and the light blocking member, read values of light at the main-scanning positions (pixel numbers) where the reflected light from the recording medium 1 is not received becomes minimal (See a time period R1 in FIG. 2).

In FIG. 2, a graph G represents the signal output of the image sensor at each of the main-scanning positions (pixel number), in conformity with the main-scanning direction (X) of the reading device 2. As indicated by the graph G, the signal output at each of the main-scanning positions (pixel numbers) of the reading device 2 during passage of the recording medium 1 sharply changes near the position of the edge 1*a*, that is, near a position of an edge of paper. When the reflectance from the recording medium 1 is high, a difference in the signal outputs between two regions across the edge 1*a* increases. Therefore, it is possible to detect a position of the edge 1*a* (edge position), that is, the position of the edge of the paper, by comparing the signal output at each of the main-scanning positions with a predetermined threshold. In contrast, in a case where the reflectance of the recording medium 1 is low, although not illustrated in the drawing, a difference in an output value between the two regions across the edge 1*a* reduces. In this case, it is difficult to detect the edge position with high accuracy only by comparing the signal output at each of the main-scanning positions and the predetermined threshold.

Figure 3:
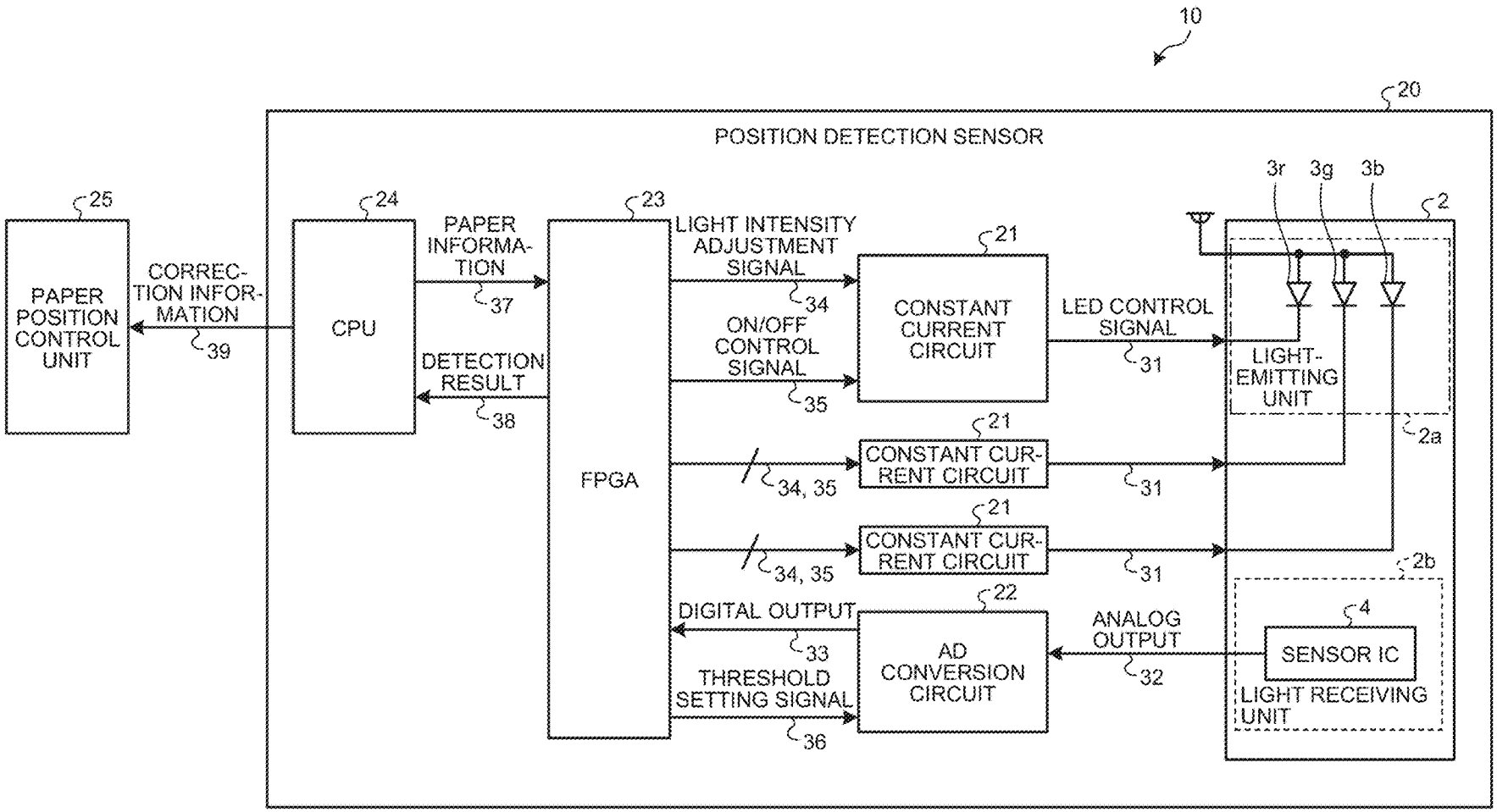
FIG. 3 is a diagram illustrating an example of a position detection sensor and a circuit configuration of peripheral components.

A circuit configuration for controlling the position detection sensor 20 will be described below with reference to FIG. 3. FIG. 3 is a diagram illustrating an example of the position detection sensor 20 and a circuit configuration of peripheral components. The reading device 2 includes a light emitting unit 2*a* and a light receiving unit 2*b*. The reading device 2 is connected with a constant current circuit 21, an analog-to-digital (AD) conversion circuit 22, a field-programmable gate array (FPGA) 23, a central processing unit (CPU) 24, and a paper position control unit 25.

The light emitting unit 2*a* includes a plurality of light emitting diodes (LEDs) with different emission wavelengths. In the present embodiment, the light emitting unit 2*a* includes a red LED 3*r*, a green LED 3*g*, and a blue LED 3*b*. The red LED 3*r*, the green LED 3*g*, and the blue LED 3*b* are one example of light sources in the present disclosure. The light emitting unit 2*a* may include an infrared LED (IR LED) in addition to the red LED 3*r*, the green LED 3*g*, and the blue LED 3*b*.

The light receiving unit 2*b* includes a sensor integrated circuit (IC) 4. The sensor IC 4 is, for example, a CMOS image sensor as described above.

The constant current circuit 21 generates an LED control signal 31 for controlling an emission state of the light emitting unit 2*a*, on the basis of a light intensity adjustment signal 34 and an ON/OFF control signal 35, which are given from the FPGA 23. Then, the constant current circuit 21 controls the emission state of the light emitting unit 2*a* for each of the LEDs by giving the LED control signal 31 to the light emitting unit 2*a*. In other words, the constant current circuit 21 is connected to each of the red LED 3*r*, the green LED 3*g*, and the blue LED 3*b*. The LED control signal 31 is a control signal for setting the number of emissions in the light emitting unit 2*a* (for selecting one or more LEDs) and/or setting light intensity (determined by a value of current applied to the LED and a current-carrying time).

The AD conversion circuit 22 acquires an analog output 32 from the light receiving unit 2*b*. The AD conversion circuit 22 binarizes the received analog output 32 by using a comparator and outputs a binarized digital output 33 to the FPGA 23. A threshold for the binarization is given by a threshold setting signal 36 from the FPGA 23.

The FPGA 23 controls operation of the constant current circuit 21 and the AD conversion circuit 22. Specifically, the FPGA 23 gives the light intensity adjustment signal 34 and the ON/OFF control signal 35 to the constant current circuit 21. It may be possible to perform lighting control of the LED by directly turning on or off the light intensity adjustment signal 34. In this case, the ON/OFF control signal 35 is not needed. The FPGA 23 gives the threshold setting signal 36 to the AD conversion circuit 22. The FPGA 23 acquires the digital output 33 from the AD conversion circuit 22 and calculates a position of an edge of the recording medium 1 (conveyed object) in the width direction.

The CPU 24 controls a positional deviation correction function. Specifically, the CPU 24 gives, to the FPGA 23, paper information 37 that includes color information on the recording medium 1 as one example of the conveyed object. Further, the CPU 24 acquires, from the FPGA 23, the position of the edge of the recording medium 1 (conveyed object) in the width direction as a detection result 38. Furthermore, the CPU 24 generates, with respect to the paper position control unit 25, correction information 39 on a paper position based on the detection result 38, and transmits the correction information 39 to the paper position control unit 25.

The paper position control unit 25 adjusts a position of the recording medium 1 in the main-scanning direction (X), on the basis of the detection result 38 acquired by the CPU 24, that is, the position of the edge of the recording medium 1 (conveyed object) in the width direction.

It may be possible to arrange, instead of the paper position control unit 25, a print position control unit (not illustrated) that controls a print position of print information to be printed on the recording medium 1 on the basis of the detection result 38, that is, the position of the edge of the recording medium 1 (conveyed object) in the width direction.

While FIG. 3 illustrates a case of using the position detection sensor 20 that outputs analog information, the position detection sensor 20 may be configured to perform AD conversion inside the sensor and output digital information. In this case, the AD conversion circuit 22 is not needed.

Functional Configuration of Image Forming Apparatus

Figure 4:
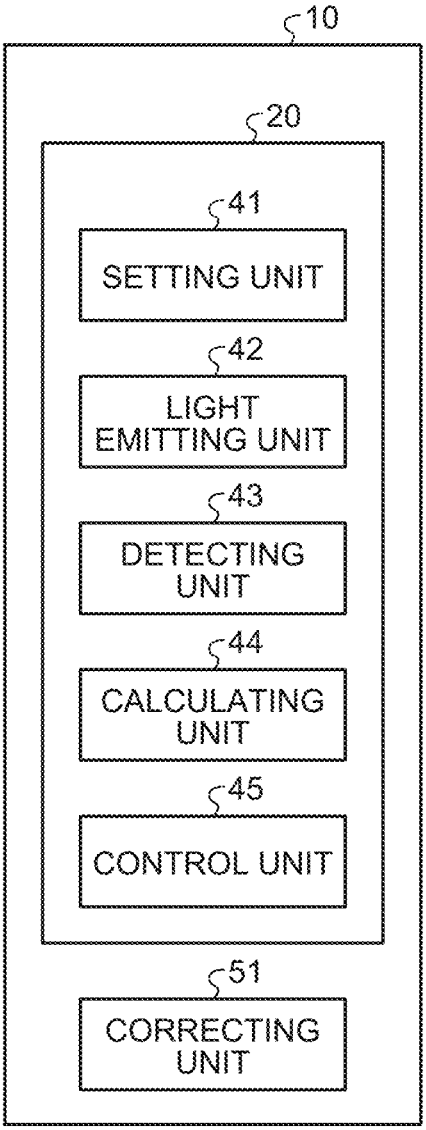
FIG. 4 is a functional block diagram illustrating an example of a functional configuration of the image forming apparatus according to the first embodiment.

A functional configuration of the image forming apparatus 10 will be described below with reference to FIG. 4. FIG. 4 is a functional block diagram illustrating an example of a functional configuration of the image forming apparatus according to the first embodiment.

As illustrated in FIG. 4, the image forming apparatus 10 includes a setting unit 41, a light emitting unit 42, a detecting unit 43, a calculating unit 44, a control unit 45, and a correcting unit 51. Among these units, the setting unit 41, the light emitting unit 42, the detecting unit 43, the calculating unit 44, and the control unit 45 are provided in the position detection sensor 20.

The setting unit 41 sets in advance an attribute of the recording medium 1 for each of the recording media 1 (conveyed objects). Specifically, the setting unit 41 generates and stores setting data, in which the attribute of the recording medium 1 (for example, information representing a type or a thickness of paper) is linked with a lighting state of the light emitting unit 42 (for example, information representing a type of the light source (LED) to be turned on, and light intensity (a lighting time or a current value)) at the time of detecting the position of the edge of the recording medium 1. The CPU 24 is one example of the setting unit 41 as a setting circuit.

The light emitting unit 42 includes a plurality of light sources with different emission wavelengths, and irradiates the recording medium 1 (conveyed object) with linear light in the width direction of the recording medium 1. The light emitting unit 2*a*, which includes red LED 3*r*, the green LED 3*g*, and the blue LED 3*b*, is one example of the light emitting unit 42 as a light emitting device.

The detecting unit 43 detects intensity of reflected light of the light emitted by the light emitting unit, at a plurality of positions on the recording medium 1 (conveyed object) in the width direction. The sensor IC 4 described above is one example of the detecting unit 43 as a detecting device.

The calculating unit 44 calculates the position of the edge of the recording medium 1 (conveyed object) in the width direction, on the basis of a detection result of the detecting unit 43. The FPGA 23 described above is one example of the calculating unit 44 as a calculating circuit.

With respect to each of the light sources included in the light emitting unit 42, the control unit 45 controls a type of a light source emitting light and light intensity of the light source, on the basis of information that is set by the setting unit 41. The constant current circuit 21 described above is one example of the control unit 45 as a control circuit. It is sufficient that the control unit 45 controls at least one of a type of a light source that emits light and light intensity of the light source on the basis of information that is set by the setting unit 41 with respect to each of the light sources included in the light emitting unit 42.

The correcting unit 51 corrects the position of the recording medium 1 and/or the print position of the print information to be printed on the recording medium 1, on the basis of the position of the edge of the recording medium 1 (conveyed object). Specifically, the position is corrected by using a well-known method in which, for example, the position of the recording medium 1 is adjusted by using a conveying position adjustment unit (not illustrated) to correct displacement of the recording medium 1 in the main-scanning direction (X) on the conveying path a to a reference position. The paper position control unit 25 and the print position control unit as described above are each one example of the correcting unit 51 as a correcting circuit.

Explanation of Example of Setting of Light Source to be Turned On

Figures 5, 6:
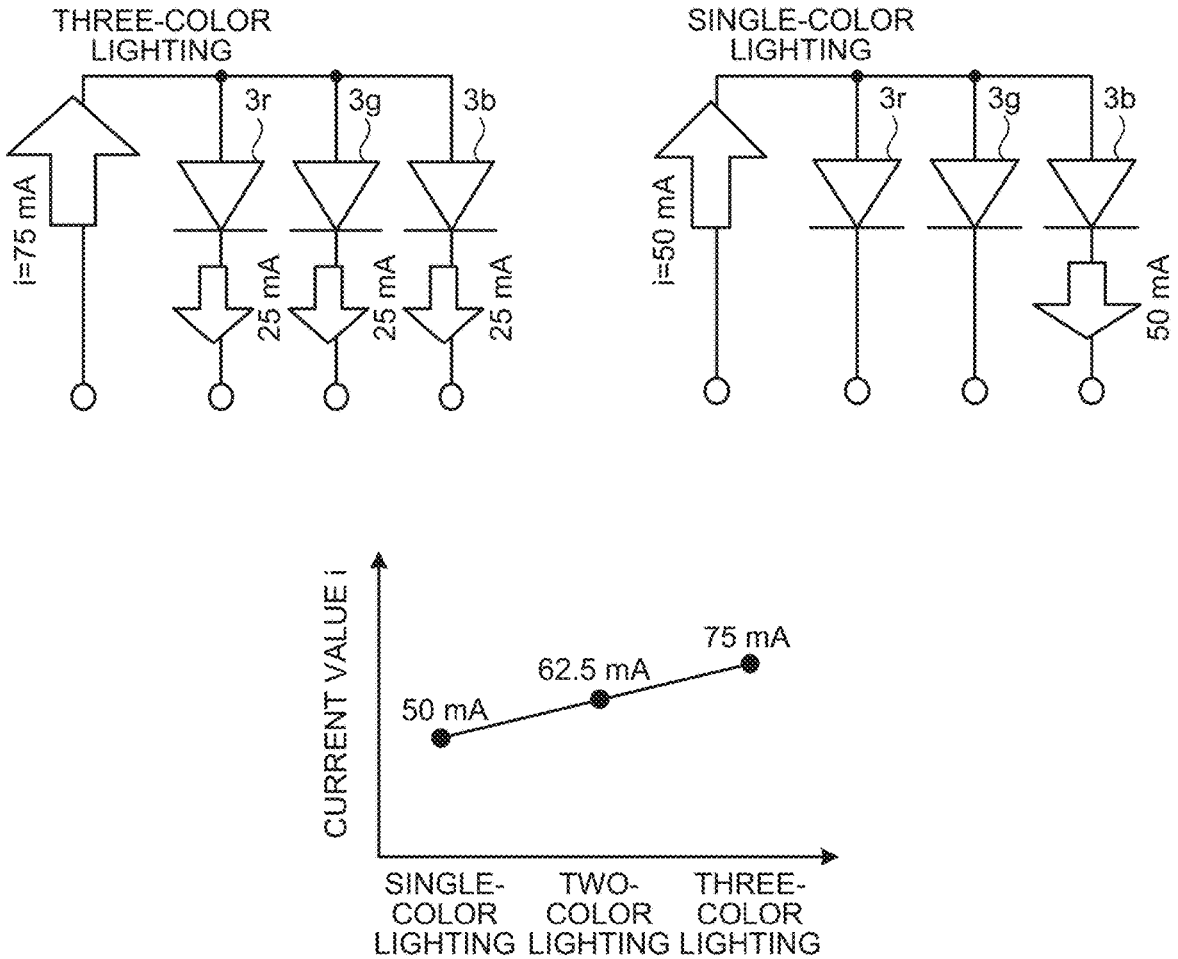
FIG. 5 is a diagram for explaining individual values of current that can be flown to light emitting diodes (LEDs) included in a light emitting unit.
FIG. 6 is a diagram illustrating an example of settings of light sources and light intensity for each of recording media.

An example of setting of the light emitting unit 42 to be turned on by the position detection sensor 20 will be described below with reference to FIG. 5 and FIG. 6. FIG. 5 is a diagram for explaining individual values of current that can be flown to the LEDs included in the light emitting unit. FIG. 6 is a diagram illustrating an example of settings of light sources and light intensity for each of recording media.

In FIG. 5, a maximum value of current is illustrated, which can be flown to the light emitting unit 2*a* in a case that a single color among the red LED 3*r*, the green LED 3*g*, and the blue LED 3*b* is lighted and in a case that the three colors (all the colors) are lighted. A total amount of values of currents that can be flown to the light emitting unit 2*a* is limited by heat quantity of a wiring package. As illustrated in the graph in FIG. 5, the maximum value of the current that can be flown varies in accordance with the number of LEDs that are turned on. Specifically, in the example in FIG. 5, the maximum value is 50 mA when light of a single color is emitted, a total of 62.5 mA when light of two colors is emitted, and a total of 75 mA when light of three colors is emitted. Note that a specific current value varies in accordance with specifications of LEDs to be used.

When the recording medium 1 has high dependency of color, it is possible, without increasing the amount of light emission, to obtain an adequately high signal output by using a light source corresponding to a wavelength of the color of the paper by single-color lighting. In the example in FIG. 6, a case is illustrated in which blue light is generated by turning on the blue LED 3*b* with respect to "blue paper", and a signal output by which a position of an edge of the paper is detectable can be obtained while suppressing the current value (a total of 50 mA). Moreover, in the example in FIG. 6, a case is illustrated in which green light is generated by turning on the green LED 3*g* with respect to "red paper", and a signal output by which a position of an edge of the paper is detectable can be obtained while suppressing the current value (a total of 50 mA).

In contrast, when the recording medium 1 does not have color dependency (for example, a black paper with high light absorptivity, a transparent paper with transparent background, or the like), it is difficult to obtain a high signal output even by using any of the light sources with the different wavelengths. Therefore, a detectable signal output is obtained by increasing emission intensity by simultaneously turning on a plurality of LEDs. In the example in FIG. 6 for "black paper", the red LED 3*r*, the green LED 3*g*, and the blue LED 3*b* are turned on, and a signal output by which a position of an edge of the paper is detectable can be obtained while suppressing the current value (a total of 60 mA). In the example in FIG. 6 for "transparent paper", the red LED 3*r*, the green LED 3*g*, and the blue LED 3*b* are turned on, and a signal output by which a position of an edge of the paper is detectable can be obtained with the maximum current value (a total of 75 mA).

Even when the plurality of LEDs are simultaneously turned on, it is possible to reduce unnecessary consumption current by setting optimal light intensity by adjusting at least one of the number of LEDs to be turned on and the amount of light emission, without turning on all the LEDs at a maximum current. Specifically, in the example in FIG. 6 for "pink paper", pink light is generated by turning on only the red LED 3*r* and the blue LED 3*b*, and a signal output by which a position of an edge of the paper is detectable can be obtained while suppressing the current value (a total of 45 mA). In the example in FIG. 6 for "yellow paper", only the red LED 3*r* and the green LED 3*g* are turned on, and a signal output by which a position of an edge of the paper is detectable can be obtained while suppressing the current value (a total of 62 mA).

Explanation of Operation of Position Detection Sensor

Figure 7:
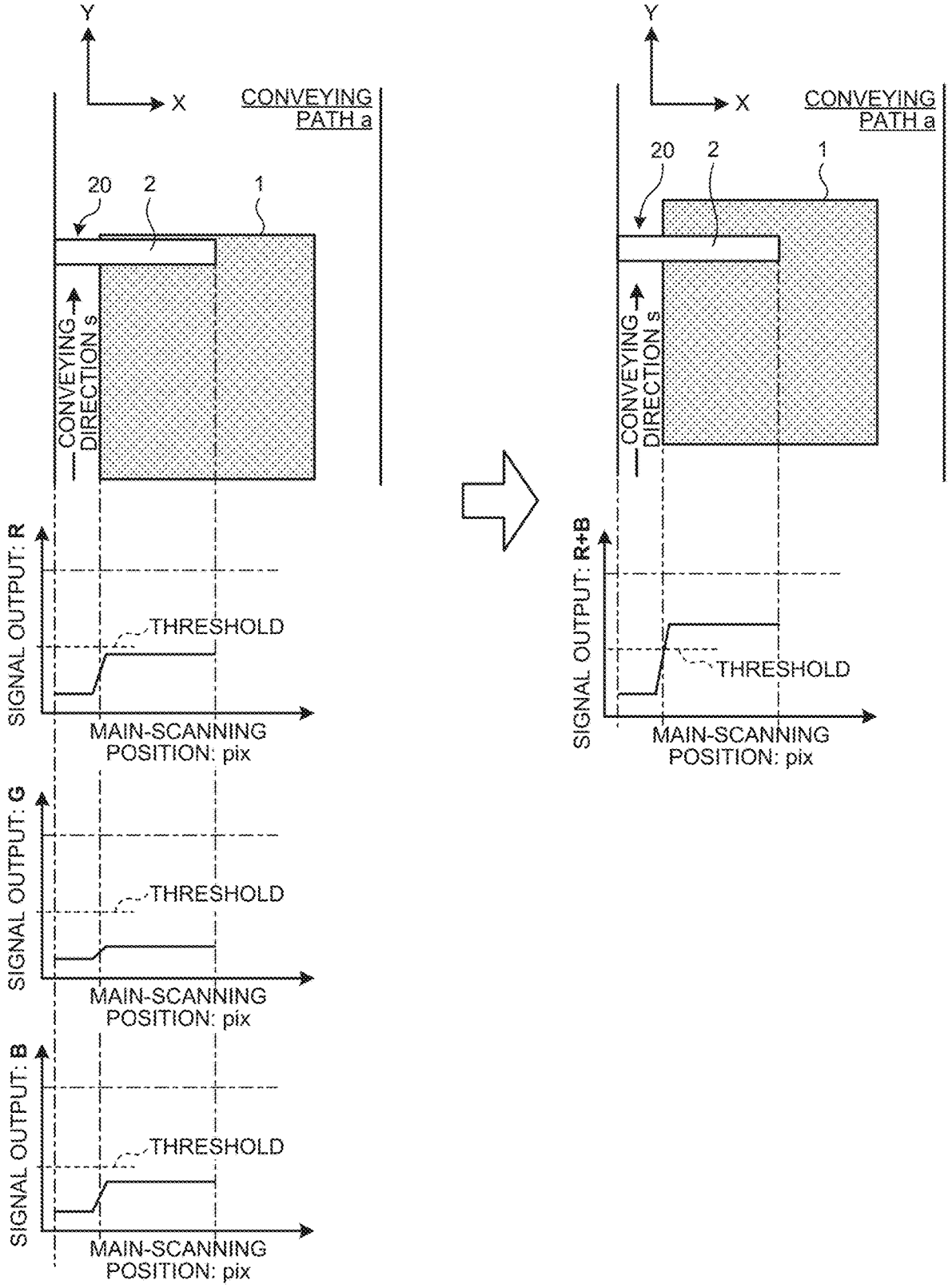
FIG. 7 is a diagram for explaining operation of the position detection sensor.

Operation of the position detection sensor 20 will be described below with reference to FIG. 7. FIG. 7 is a diagram for explaining operation of the position detection sensor. The left of FIG. 7 illustrates a signal output obtained when the recording medium 1 in a pink color is detected while the red LED 3*r*, the green LED 3*g*, and the blue LED 3*b* (see FIG. 3) included in the reading device 2 are all turned on. The right of FIG. 7 illustrates a signal output obtained when the recording medium 1 in the pink color is detected while only the red LED 3*r* and the blue LED 3*b* are turned on.

According to the left of FIG. 7 illustrating the signal output by the single-color light source, a signal output R for the red LED 3*r* most largely changes between the light shielding member and the recording medium 1. However, it can be found that it is difficult to obtain output power larger than a threshold by independently turning on any one of the LEDs. Therefore, it is difficult to detect the position of the edge of the recording medium 1 in the pink color by the single-color light source.

In contrast, the right of FIG. 7 illustrates pieces of light at wavelengths corresponding to the pink color are output by simultaneously turning on the red LED 3*r* and the blue LED 3*b* on the basis of the paper information, that is, based on the color of the paper. In this case, it can be found that a signal output "R+B" exceeds the threshold and it is possible to detect the position of the edge of the recording medium 1 in the pink color. In this manner, by selecting a light source to be turned on based on the color of the recording medium (such as paper color), it is possible to detect the position of the edge of various kinds of the recording medium 1.

If the red LED 3*r*, the green LED 3*g*, and the blue LED 3*b* in the reading device 2 are turned on simply at the same time, an amount of light emission is excessive for paper having high reflectance (that is, low absorptivity of light). In this case, power consumption of the position detection sensor 20 increases. In contrast, as illustrated in the right of FIG. 7, it is possible to reduce the power consumption of the position detection sensor 20 by selectively turning on light sources corresponding to paper.

Further, when a plurality of LEDs are simultaneously turned on, it is possible to reduce unnecessary consumption current and achieve power saving in a conventional multiple-lighting system by turning on those LEDs while adjusting the amounts of light emission, instead of turning on the LEDs at maximum light intensity.

As for a light source and a degree of light intensity to be adopted for a certain kind of paper, it is sufficient to cause the setting unit 41 as described above to perform an evaluation experiment or the like in advance and generate the setting data in which the attribute of the recording medium 1 (conveyed manner) and a lighting state of the light emitting unit 42 capable of detecting the position of the edge of the recording medium 1 are linked. The generated setting data is stored in a storage unit (not illustrated in FIG. 3) that is connected to the CPU 24, read at the start of printing, and used at the time of detecting the position of the edge of the recording medium 1.

Explanation of Flow of Process Performed by Position Detection Sensor

Figure 8:
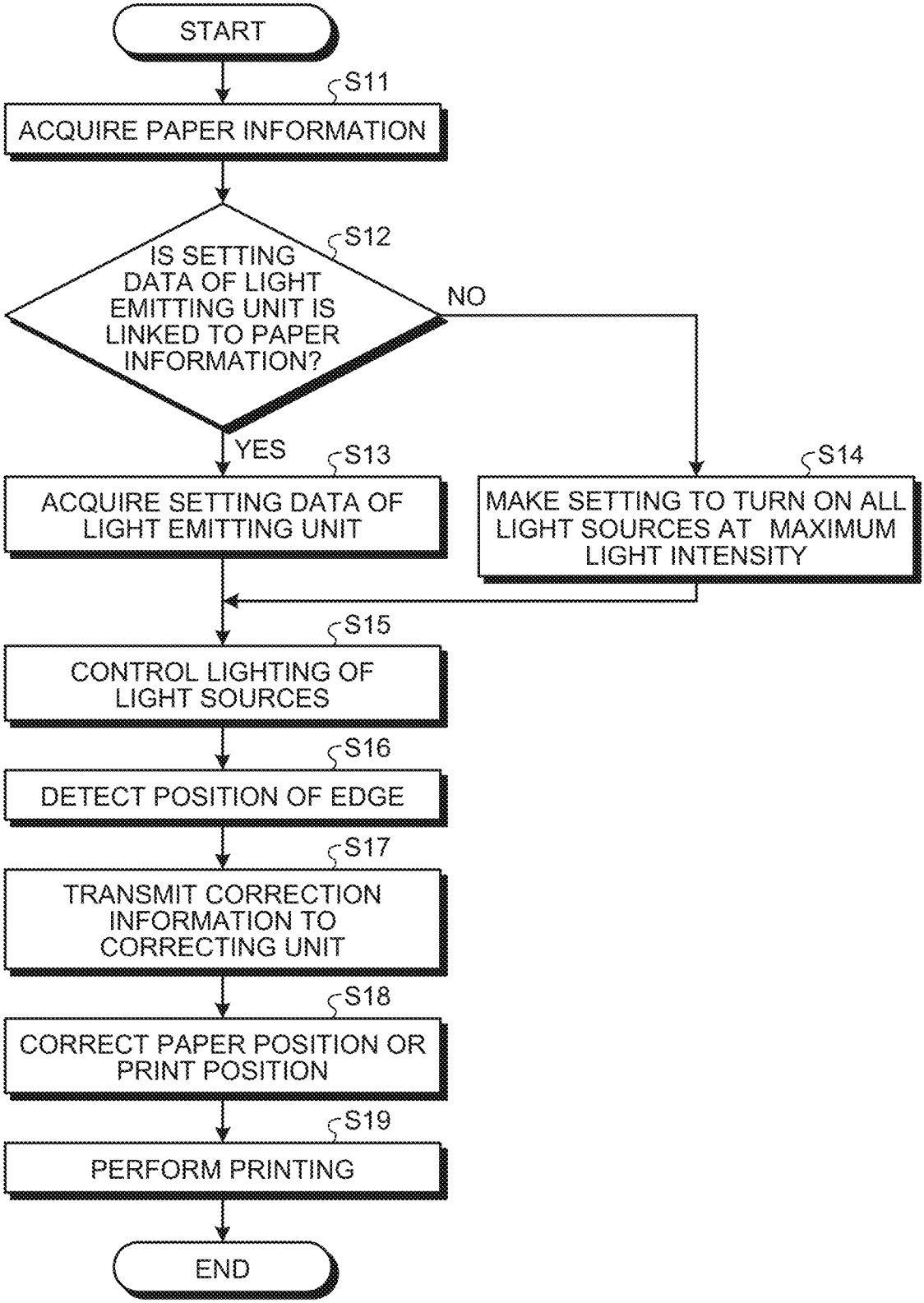
FIG. 8 is a flowchart illustrating an example of the flow of a process performed by the position detection sensor of the first embodiment.

The flow of a process performed by the position detection sensor 20 will be described below with reference to FIG. 8. FIG. 8 is a flowchart illustrating an example of a process performed by the position detection sensor of the first embodiment.

The FPGA 23 (the calculating unit 44) acquires paper information (37) from the CPU 24 (the setting unit 41) (Step S11).

The FPGA 23 determines whether the setting data indicating the lighting state of the light emitting unit 42 is linked to the paper information (Step S12). When it is determined that the setting data is linked to the paper information (YES at Step S12), the process proceeds to Step S13. In contrast, when it is not determined that the setting data is linked to the paper information (NO at Step S12), the process proceeds to Step S14.

When it is determined as Yes at Step S12, the FPGA 23 acquires the setting data of the light emitting unit from the CPU 24 (Step S13). Thereafter, the process proceeds to Step S15.

When it is determined as No at Step S12, the FPGA 23 makes a setting to turn on all the light sources at maximum light intensity (Step S14). Thereafter, the process proceeds to Step S15.

The FPGA 23 causes the constant current circuit 21 (the control unit 45) to control lighting of the light sources (the red LED 3*r*, the green LED 3*g*, and the blue LED 3*b*) on the basis of a result obtained at Step S13 or Step S14 (Step S15).

The FPGA 23 (the calculating unit 44) performs detection of the position of the edge of the recording medium 1 (Step S16).

The CPU 24 transmits, to the paper position control unit 25, the correction information 39 that is based on the detection result 38 of the position of the edge of the recording medium 1 (Step S17).

The paper position control unit 25 corrects a paper position or a print position (Step S18).

The image forming apparatus 10 performs printing in a state that the paper position or the print position has been corrected (Step S19). Then, the image forming apparatus 10 terminates the process in FIG. 8.

As described above, according to the position detection sensor 20 (edge position detecting apparatus) of the first embodiment, the control unit 45 controls a type of a light source to be turned on and/or light intensity of the light source in the light emitting unit 42. The light emitting unit 42 includes a plurality of light sources with different emission wavelength and irradiates the recording medium 1 (conveyed object) with linear light in the width direction of the recording medium 1. Then, the detecting unit 43 detects, at a plurality of positions on the recording medium 1 in the width direction, intensity of reflected light of the light emitted by the light emitting unit 42, and the calculating unit 44 calculates the position of the edge of the recording medium 1 on the basis of a detection result of the detecting unit 43. Therefore, it is possible to reduce power consumption of the position detection sensor 20 and handling various kinds of the recording media 1 without deterioration of detection accuracy of the position of the edge of the recording medium 1.

In addition, according to the position detection sensor 20 (edge position detecting apparatus) of the first embodiment, the setting unit 41 sets in advance the attribute of the recording medium 1 for each of the recording media 1 (conveyed object). Then, the control unit 45 controls a type of a light source to be turned on and/or light intensity of the light source on the basis of setting contents of the setting unit 41. Therefore, it is possible to prepare in advance the setting data in which a lighting state of the light emitting unit 42 is defined for each kind of the recording medium 1. Consequently, it is possible to effectively perform printing of images and characters.

Furthermore, according to the image forming apparatus 10 of the first embodiment, the correcting unit 51 corrects the position of the recording medium 1 (conveyed object) and/or the print position of the print information to be printed on the recording medium 1, on the basis of the position of the edge of the recording medium 1 (conveyed object). Therefore, it is possible to perform printing of images and characters at appropriate positions on the recording medium 1.

Second Embodiment

An image forming apparatus 10*a* according to a second embodiment will be described below with reference to the accompanying drawings. The image forming apparatus 10*a* includes a position detection sensor 20*a* (edge position detecting apparatus). Before performing printing of an image or a character, the image forming apparatus 10*a* conveys in the sub-scanning direction (Y) the recording medium 1, which is set on the conveying path a, to a position at which the reading device 2 is able to detect the position of the edge of the recording medium 1. Thereafter, the position detection sensor 20*a* turns on a plurality of different combinations of light sources included in the reading device 2, and compares a signal output detected by the detecting unit 43 in each case. Then, the position detection sensor 20*a* determines a combination of light sources being optimal to detect the position of the edge of the set recording medium 1 and/or determines light intensity of the light sources. The image forming apparatus 10*a* turns on the plurality of light sources included in the reading device 2 in accordance with the selected combination of light sources and/or the selected light intensity, detects the position of the edge of the recording medium 1, and performs printing of an image or a character at a predetermined position on the recording medium 1. Note that a hardware configuration of the position detection sensor 20*a* is the same as the hardware configuration (see FIG. 3) of the position detection sensor 20 as described above, and therefore, explanation thereof will be omitted. Further, in the following description, the same names and the same reference symbols as illustrated in FIG. 3 will be used.

Functional Configuration of Image Forming Apparatus

Figure 9:
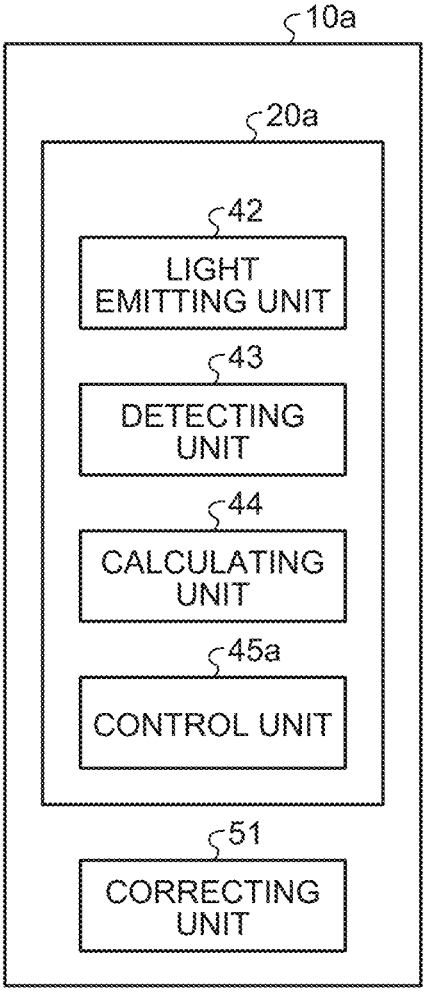
FIG. 9 is a functional block diagram illustrating an example of a functional configuration of an image forming apparatus according to a second embodiment.

A functional configuration of the image forming apparatus 10*a* will be described below with reference to FIG. 9. FIG. 9 is a functional block diagram illustrating an example of the functional configuration of the image forming apparatus according to the second embodiment.

As illustrated in FIG. 9, the image forming apparatus 10*a* includes the light emitting unit 42, the detecting unit 43, the calculating unit 44, a control unit 45*a*, and the correcting unit 51. Among these units, the light emitting unit 42, the detecting unit 43, the calculating unit 44, and the control unit 45*a* are provided in the position detection sensor 20*a*.

When the plurality of light sources (the red LED 3*r*, the green LED 3*g*, and the blue LED 3*b*) of the light emitting unit 42 are turned on in a plurality of different combinations (a combination of types of light sources to be turned on and light intensity), the control unit 45*a* compares signal outputs detected by the detecting unit 43, and selects a combination of light sources used for detecting the position of the edge of the recording medium 1 and/or selects light intensity of the light sources. Further, the control unit 45*a* controls an emission state of each of the light sources included in the light emitting unit 42 on the basis of the selected information. The CPU 24 and the constant current circuit 21 in FIG. 3 are each one example of the control unit 45*a* as a control circuit.

Operation of the other functional units is the same as those described in the first embodiment, and therefore, explanation thereof will be omitted.

Explanation of Flow of Process Performed by Position Detection Sensor

Figure 10:
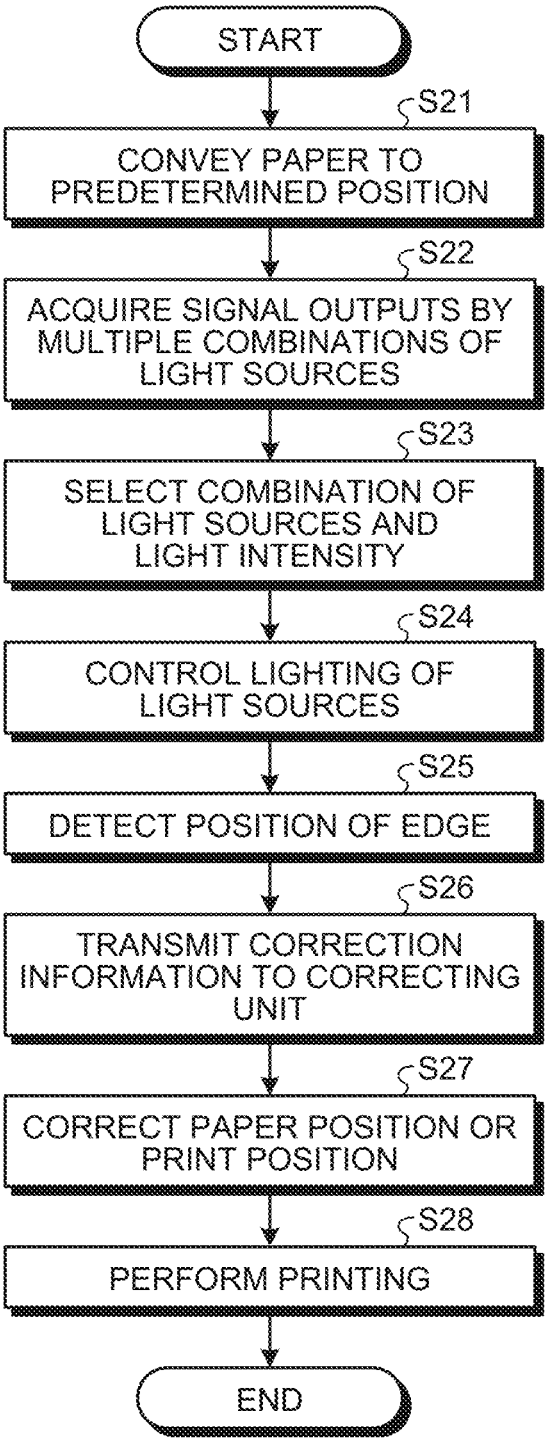
FIG. 10 is a flowchart illustrating an example of the flow of a process performed by a position detection sensor of the second embodiment.

The flow of a process performed by the position detection sensor 20*a* will be described below with reference to FIG. 10. FIG. 10 is a flowchart illustrating an example of the flow of a process performed by the position detection sensor of the second embodiment.

The image forming apparatus 10*a* conveys the recording medium 1 (paper) to a predetermined position at which the position of the edge of the recording medium 1 is able to be detected (Step S21).

The CPU 24 (the control unit 45*a*) causes the constant current circuit 21 to turn on a plurality of different combinations of light sources included in the light emitting unit 42. Further, the sensor IC 4 (the detecting unit 43) acquires a signal output every time the light emitting unit 42 emits light in a different pattern (Step S22).

The CPU 24 (the control unit 45*a*) compares the signal outputs acquired at Step S22, and selects a combination of light sources and/or selects light intensity of the light sources (Step S23).

The FPGA 23 causes the constant current circuit 21 (the control unit 45*a*) to turn on the light sources (the red LED 3*r*, the green LED 3*g*, and the blue LED 3*b*), on the basis of the paper information 37 acquired from the CPU 24 (Step S24).

The FPGA 23 (the calculating unit 44) performs detection of the position of the edge of the recording medium 1 (Step S25).

The CPU 24 transmits, to the paper position control unit 25, the correction information 39 that is based on the detection result 38 of the position of the edge of the recording medium 1 (Step S26).

The paper position control unit 25 corrects a paper position or a print position (Step S27).

The image forming apparatus 10*a* performs printing in a state in which the paper position or the print position is corrected (Step S28). Then, the image forming apparatus 10*a* completes the process in FIG. 10.

As described above, according to the position detection sensor 20*a* (edge position detecting apparatus) of the second embodiment, when a plurality of different combinations of light sources included in the light emitting unit 42 are turned on at different light intensity, the control unit 45*a* compares signal outputs detected by the detecting unit 43, and selects a combination of light sources used for detecting the position of the edge of the recording medium 1, and/or selects light intensity of the light sources. Therefore, even for the recording medium 1 in which the setting data as described above in the first embodiment is not set, it is possible to detect the position of the edge of the recording medium 1 at high accuracy and low power consumption. Note that, when a paper type (for example, a color of paper) is known in advance, it may be possible to restrict a combination condition of the light sources. For example, when it is known that the color of the paper is red, it is not necessary to turn on combinations of all RGB LEDs, but it is sufficient to turn on only the red LED 3*r* and adjust only light intensity (current value) or a lighting time of the red LED 3*r*.

The present invention has an advantage of reducing power consumption and handling various kinds of paper without deterioration of detection accuracy.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An edge position detecting apparatus comprising:

a light emitting device including a plurality of light sources with different emission wavelengths, the light emitting device being configured to irradiate a conveyed object with linear light along a width direction of the conveyed object, the width direction being perpendicular to a conveying direction of the conveyed object;

a detecting device configured to detect, at a plurality of positions in the width direction of the conveyed object, intensity of reflected light of light emitted by the light emitting device; and processing circuitry configured to, select a set of selected light sources from among the plurality of light sources based on an attribute of the conveyed object, control light emission of the plurality of light sources to simultaneously illuminate the set of selected light sources, and calculate, based on a detection result of the detecting device, a position of an edge of the conveyed object in the width direction.

2. The edge position detecting apparatus according to claim 1, wherein the processing circuitry is further configured to set one or more of the set of selected light sources and a light intensity of the set of selected light sources prior to performing a printing operation on the conveyed object by, varying the set of selected light sources to form a plurality of sets of potential light sources and varying the light emission of the plurality of sets of potential light sources, comparing intensity detected by the detecting device; and selecting one of the plurality of sets of potential light sources as the set of selected light sources and the light intensity of the set of selected light sources prior to utilize when performing the printing operation on the conveyed object.

3. The edge position detecting apparatus according to claim 2, wherein the attribute is a color of the conveyed object.

4. The edge position detecting apparatus according to claim 2, wherein, the processing circuitry is configured to simultaneously illuminate two or more of the plurality of light sources, in response to the attribute of the conveyed object satisfying a set criteria such that the processing circuitry controls a timing of light emission and light intensity of each of the two or more of the plurality of light sources simultaneously illuminated.

5. The edge position detecting apparatus according to claim 1, wherein the attribute is a type of the conveyed object.

6. An image forming apparatus comprising:

the edge position detecting apparatus according to claim 1; and a correcting circuit configured to correct the position of the conveyed object and/or a print position of print information to be printed on the conveyed object, based on the position of the edge of the conveyed object detected by the edge position detecting apparatus.

7. The edge position detecting apparatus of claim 1, wherein the set of selected light sources has a maximum current value associated therewith, and the processing circuitry is configured to control light emission to simultaneously illuminate the set of selected light sources while suppressing a current value to a set current value below the maximum current value associated with the set of selected light sources.

8. The edge position detecting apparatus of claim 7, wherein the set current value varies based on the attribute of the conveyed object.

9. The edge position detecting apparatus of claim 1, wherein the attribute includes a color of the conveyed object.

10. The edge position detecting apparatus of claim 9, wherein the processing circuitry is configured to set the set of selected light sources that are simultaneously illuminated to include two or more light sources among the plurality of light sources when the color of the conveyed object is at least one of yellow, pink, black or transparent.

11. The edge position detecting apparatus of claim 9, wherein the processing circuitry is configured to set the set of selected light sources to include an increased number of light sources when the color of the conveyed object is at least one of black or transparent as compared to when the color is at least one of blue, red, yellow, or pink.

12. The edge position detecting apparatus of claim 11, wherein the processing circuitry is configured to set a current value of each of the selected light sources in the set of selected light sources to a maximum current value, when the color is transparent.

* * * * *